US008696438B2

(12) United States Patent
Englman et al.

(10) Patent No.: US 8,696,438 B2
(45) Date of Patent: Apr. 15, 2014

(54) WAGERING GAME WITH A SECONDARY GAME DETERMINED BY SYMBOL POSITIONS IN A BASE GAME

(75) Inventors: Allon G. Englman, Chicago, IL (US); Jeremy M. Hornik, Chicago, IL (US); Jeffry L. Nauman, Yorkville, IL (US); Pamela S. Smith, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 212 days.

(21) Appl. No.: 13/413,855

(22) Filed: Mar. 7, 2012

(65) Prior Publication Data

US 2012/0231869 A1 Sep. 13, 2012

Related U.S. Application Data

(60) Provisional application No. 61/450,967, filed on Mar. 9, 2011.

(51) Int. Cl.
*A63F 9/24* (2006.01)

(52) U.S. Cl.
USPC ..... 463/20; 463/16; 463/17; 463/18; 463/21

(58) Field of Classification Search
USPC ..... 463/16–22
See application file for complete search history.

(56) References Cited

U.S. PATENT DOCUMENTS

| | | | | |
|---|---|---|---|---|
| 5,980,384 | A * | 11/1999 | Barrie | 463/16 |
| 6,280,328 | B1 | 8/2001 | Holch et al. | |
| 6,409,172 | B1 | 6/2002 | Vancura | |
| 6,517,433 | B2 | 2/2003 | Loose et al. | |
| 6,726,562 | B2 | 4/2004 | Vancura | |
| 6,997,805 | B2 | 2/2006 | Vancura | |
| 7,237,775 | B2 | 7/2007 | Thomas et al. | |
| 7,614,953 | B2 | 11/2009 | Souza et al. | |
| 2003/0045354 | A1 | 3/2003 | Giobbi | |
| 2003/0064785 | A1 * | 4/2003 | Stone et al. | 463/20 |
| 2006/0252486 | A1 * | 11/2006 | Walker et al. | 463/16 |
| 2008/0188286 | A1 | 8/2008 | Jaffe | |
| 2009/0005145 | A1 * | 1/2009 | White | 463/16 |
| 2009/0104986 | A1 | 4/2009 | Englman et al. | |
| 2009/0239631 | A1 * | 9/2009 | Aoki et al. | 463/20 |
| 2011/0098102 | A1 | 4/2011 | Gomez et al. | |

FOREIGN PATENT DOCUMENTS

| | | |
|---|---|---|
| WO | WO 2006/014770 | 2/2006 |
| WO | WO 2006/014990 | 2/2006 |
| WO | WO 2006/130611 | 12/2006 |
| WO | WO 2007/030670 | 3/2007 |
| WO | WO 2007/089410 | 8/2007 |

* cited by examiner

*Primary Examiner* — Tramar Harper
(74) *Attorney, Agent, or Firm* — Nixon Peabody LLP

(57) ABSTRACT

A system for playing a wagering game has basic and secondary games. The secondary game includes bonus games. Symbols are arranged in an array of symbol positions in a first display for the basic game. Each symbol position has a corresponding position in an array of bonus-game positions in a second display for the secondary game. Each bonus-game position is linked to a different bonus game. The symbols displayed in the array of symbol positions are varied during play of the basic game. The symbols include secondary game trigger symbols. If a secondary game trigger symbol is displayed in a symbol position, the corresponding position in the array of bonus-game positions for the secondary game is identified. If a predetermined number of bonus-game positions are identified, the secondary game is completed by implementing each of the different bonus games linked to the identified bonus-game positions.

24 Claims, 9 Drawing Sheets

WAGERING GAME WITH A SECONDARY GAME DETERMINED BY SYMBOL POSITIONS IN A BASE GAME

CROSS-REFERENCE TO RELATED APPLICATION

This application is related to and claims the benefits of U.S. patent application Ser. No. 61/450,967, filed Mar. 9, 2011, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming system, and methods for playing wagering games, and more particularly, to a secondary game determined by symbol positions in a base game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

To maintain a player's interest in a game, some players can be motivated by a bonus game played in conjunction with a basic game. The bonus game, which may include a game either similar to or different from the basic game, is entered upon the occurrence of a selected event or outcome in the basic game.

SUMMARY OF THE INVENTION

According to one aspect of the present disclosure, a gaming system includes an input device configured to receive a wager to play a wagering game having a basic game and a secondary game. The secondary game includes a plurality of bonus games. One or more display devices are configured to display a plurality of symbols arranged in an array of symbol positions in a first display area for the basic game. Each symbol position has a corresponding position in an array of bonus-game positions in a second display area for the secondary game. Each bonus-game position is linked to a different bonus game. One or more processors are operative to vary the symbols displayed in the array of symbol positions during play of the basic game. The symbols include one or more secondary game trigger symbols. In response to a secondary game trigger symbol being displayed in a symbol position, the corresponding position in the array of bonus-game positions for the secondary game is identified. In response to a predetermined number of bonus-game positions being identified, the secondary game is completed by implementing each of the different bonus games linked to the identified bonus-game positions.

According to another aspect of the present disclosure, a method of conducting a wagering game on a gaming system includes the acts of: (a) receiving an input via a user interface device, the input indicative of a wager to play the wagering game; (b) after receiving the input, initiating a base game of the wagering game via one or more processors; (c) displaying, via one or more display devices, a plurality of symbols arranged in an array of symbol positions in a first display area for the base game, the symbols including one or more special symbols, each symbol position having a corresponding bonus-game position in an array of bonus-game positions in a second display area, each bonus-game position linked to a different bonus game; (d) in response to a special symbol being displayed in a symbol position during play of the base game, identifying the corresponding bonus-game position in the array of bonus-game positions; (e) repeating acts (a) through (d) until a plurality of bonus-game positions are identified; and (f) in response to a plurality of bonus-game positions being identified, implementing each of the different bonus games linked to the identified bonus-game positions.

According to yet another aspect of the present disclosure, a gaming machine is configured to play a wagering game having a basic game and a secondary game including a plurality of bonus games. The gaming machine includes an input device configured to receive a wager to play the basic game. One or more display devices are configured to display a plurality of symbols arranged in an array of symbol positions in a primary display area associated with the basic game. Each symbol position has a corresponding bonus-event position in an array of bonus-event positions in a secondary display area associated with the secondary game. Each bonus-event position of the secondary game is linked to a different bonus game. One or more processors are operative to vary the symbols displayed in the array of symbol positions during play of the basic game. The symbols include one or more bonus-event symbols. In response to a bonus-event symbol being displayed in a symbol position during play of the basic game, the corresponding bonus-event position is identified in the array of bonus-event positions for the secondary game. In response to a predetermined number of bonus-event positions being identified for the secondary game, the secondary game is completed by implementing each of the different bonus games linked to the identified bonus-event positions. Immediately after completing the secondary game, play of the basic game is resumed.

According to another aspect of the present disclosure, a computer-implemented method can include: (a) receiving a wager via at least one input device; (b) in response to receiving the wager, initiating a basic game via one or more processors; (c) displaying, on at least one display device, a plurality of symbols arranged in an array of basic-game symbol positions, the symbols including one or more special symbols, each basic-game symbol position having a corresponding bonus-game position in an array of bonus-game positions in a second display area, each bonus-game position linked to a different bonus game; (d) in response to a special symbol being displayed in a basic-game symbol position during the basic game, identifying the corresponding bonus-game position in the array of bonus-game positions; (e) repeating acts (a) through (d) until a plurality of bonus-game positions are identified; and (f) in response to a plurality of bonus-game positions being identified, implementing each of the different bonus games linked to the identified bonus-game positions.

According to yet another aspect of the present disclosure, a gaming system includes at least one input device, at least one display device, at least one processor, and at least one memory device which stores a plurality of instructions which, when executed by the at least one processor, cause the at least one processor to operate with the at least one display device and the least one input device to implement several acts including: (a) receiving a wager, (b) in response to receiving the wager, initiating a basic game and a secondary game, the secondary game including a plurality of bonus games, (c) displaying, on the at least one display device, a plurality of symbols arranged in an array of symbol positions in a first display area for the basic game, each symbol position having a corresponding position in an array of bonus-game positions in a second display area for the secondary game, each bonus-game position linked to a different bonus game, (d) vary the symbols displayed in the array of symbol positions during play of the basic game, the symbols including one or more secondary game trigger symbols, (e) in response to a secondary game trigger symbol being displayed in a symbol position, identifying the corresponding position in the array of bonus-game positions for the secondary game, and (f) in response to a plurality of bonus-game positions being identified, completing the secondary game by implementing each of the different bonus games linked to the identified bonus-game positions.

According to a further aspect of the present disclosure, a computer program product includes a non-transitory computer readable medium having an instruction set borne thereby. The instruction set is configured to cause upon execution by a controller the above methods.

Additional aspects of the invention will be apparent to those of ordinary skill in the art in view of the detailed description of various aspects of the present disclosure, which is made with reference to the drawings, a brief description of which is provided below.

Figure 1:
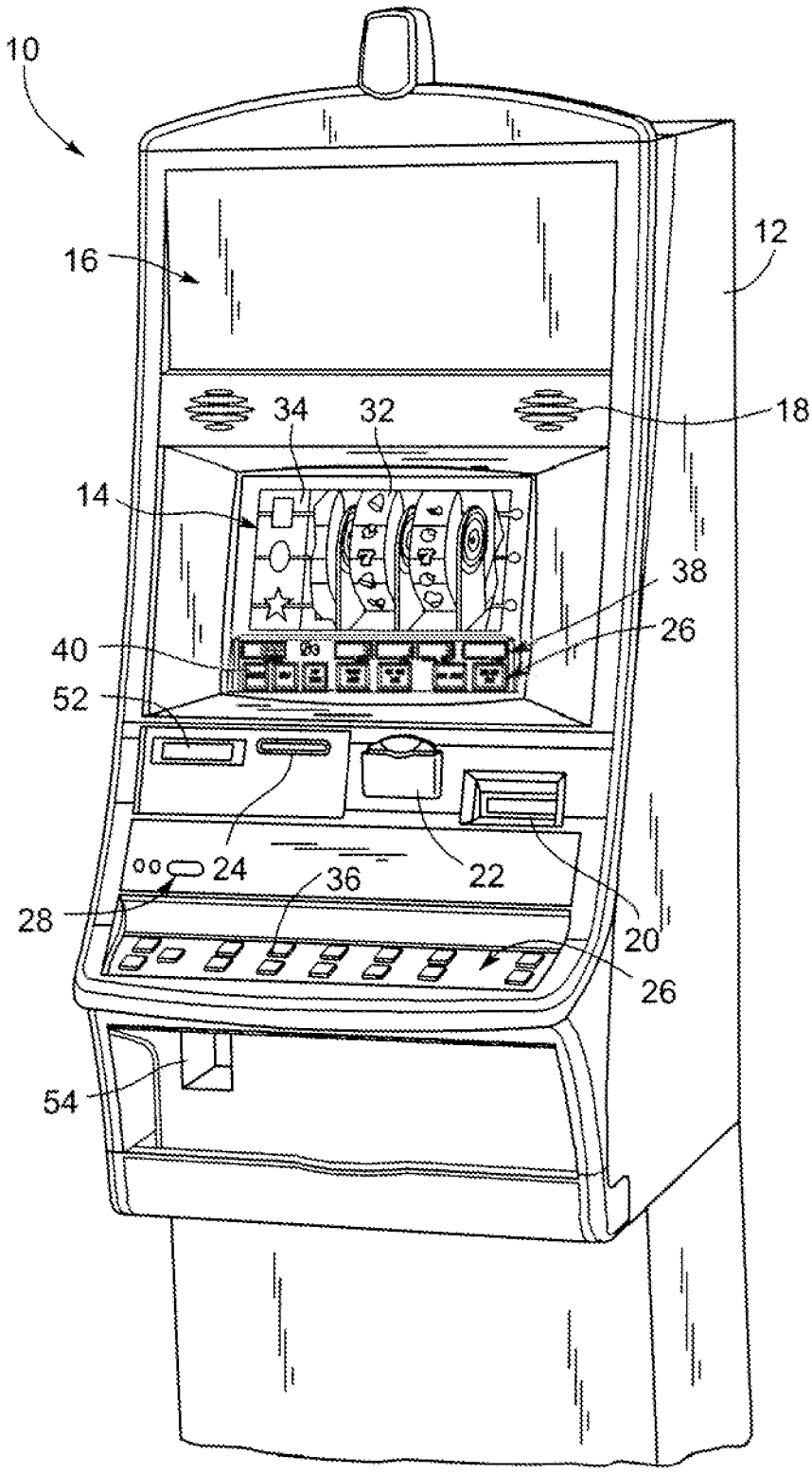
FIG. 1 (PRIOR ART)
FIG. 1 is a perspective view of a free-standing gaming terminal, according to an exemplary aspect of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
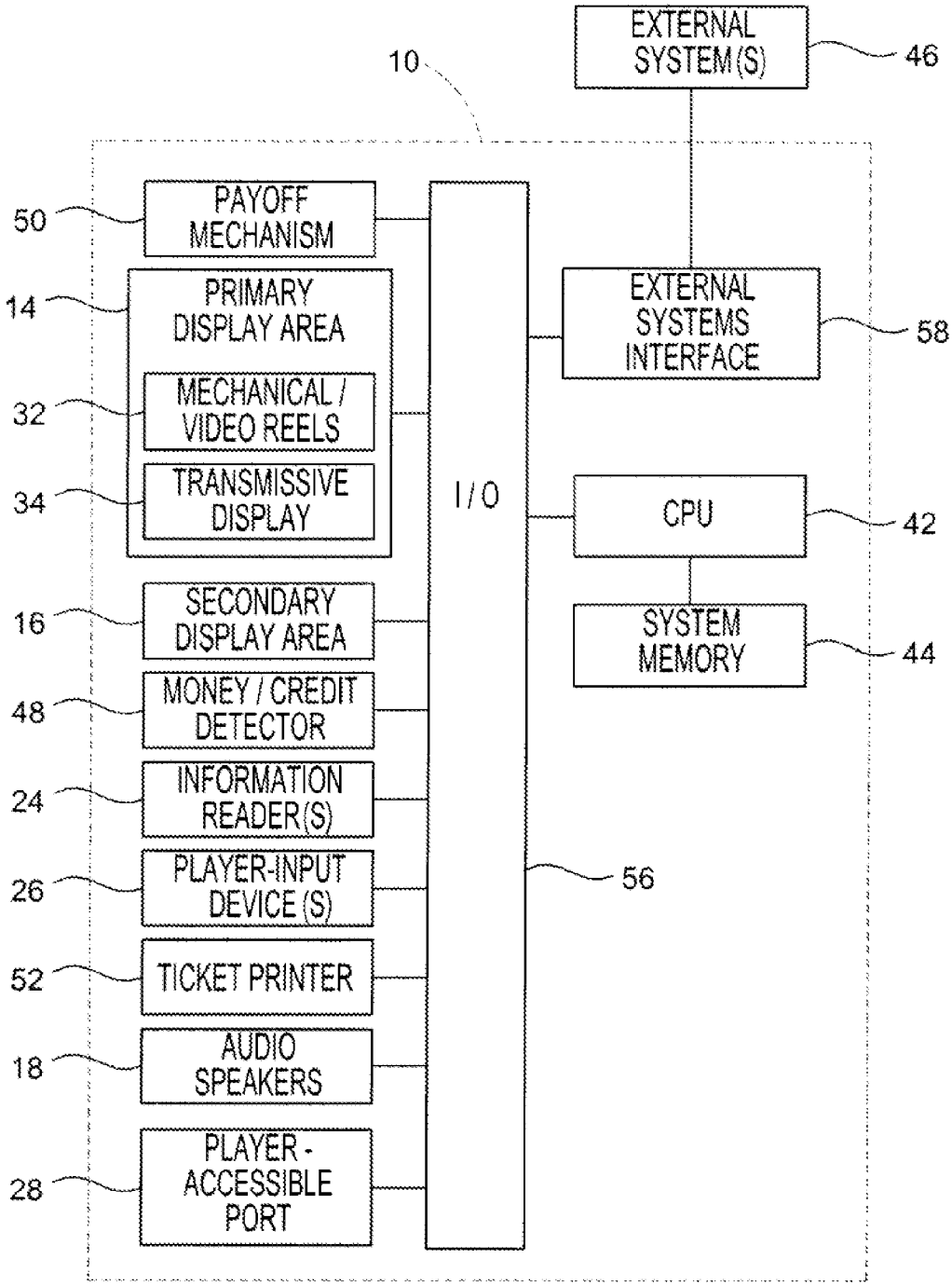
FIG. 2 (PRIOR ART)
FIG. 2 is a schematic view of a gaming system, according to an exemplary aspect of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10 bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
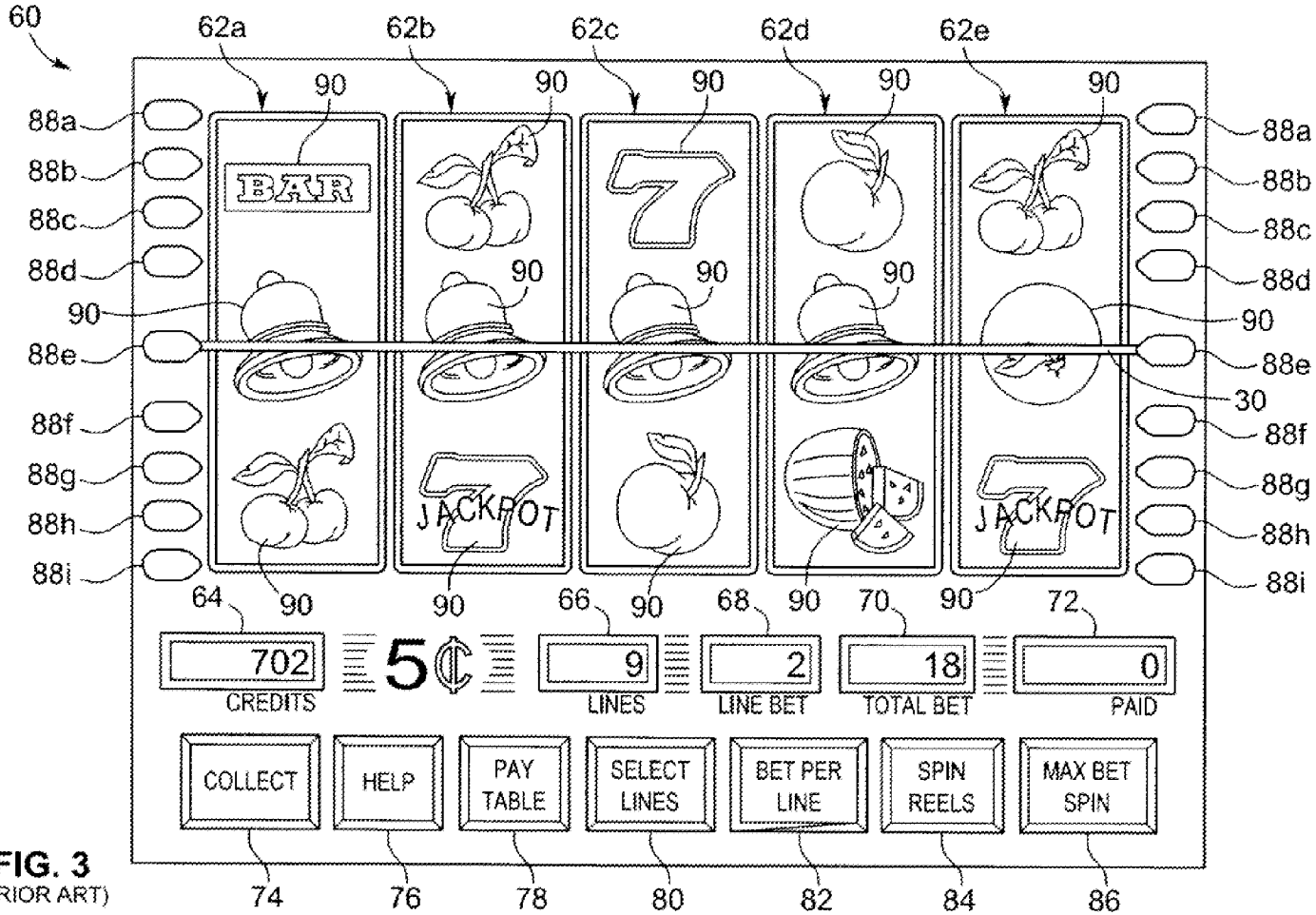
FIG. 3 (PRIOR ART)
FIG. 3 is an image of a basic-game screen of a wagering game displayed on a gaming terminal, according to an exemplary aspect of the present disclosure.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 4:
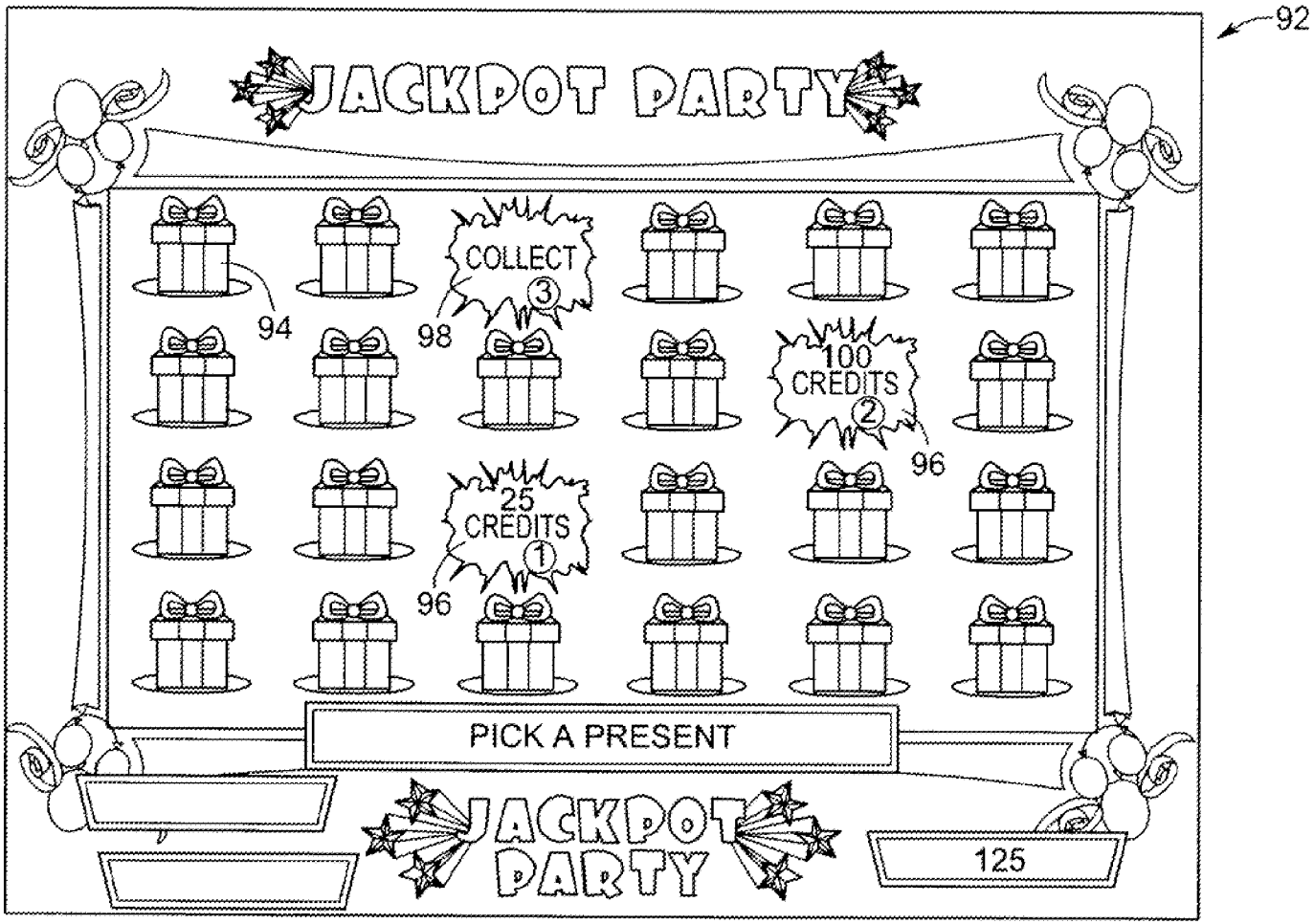
FIG. 4 (PRIOR ART)
FIG. 4 is an image of a bonus-game screen of a wagering game displayed on a gaming terminal, according to an exemplary aspect of the present disclosure.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
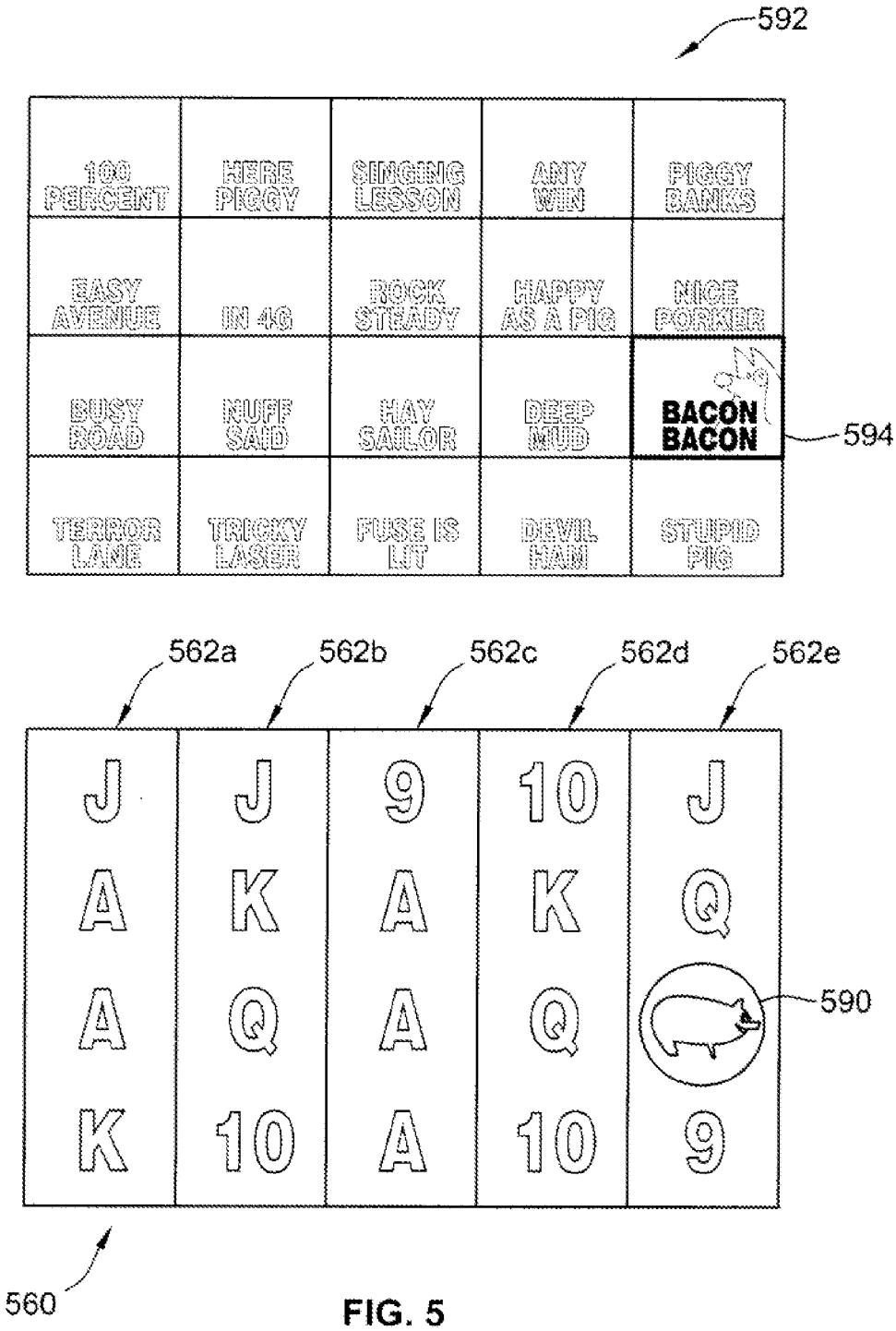
FIG. 5 is an image of a plurality of simulated movable reels for a basic game and a plurality of bonus game selections for a secondary game displayed on a wagering gaming terminal, according to an exemplary aspect of the present disclosure.

Referring now to FIG. 5, a first image 560 of a plurality of simulated movable reels 562*a-e* is illustrated for a basic game, and a second image 592 of a plurality of bonus game selections (e.g., Bacon Bacon, 100 Percent, Easy Avenue, Devil Ham) is illustrated for a secondary game. Images 560, 592 can be displayed as part of the primary display area 14 and/or the secondary display area 16 described by way of example in FIGS. 1 and 2. The simulated movable reels 562*a-e* illustrate an exemplary aspect of a plurality of symbols arranged in an array of symbol positions for a basic game. The secondary game grid illustrated in second image 592 includes bonus game selections arranged in an array of bonus-game positions (e.g., 594).

The exemplary basic game grid illustrated by image 560 includes five columns (e.g., reels) by 4 rows for a total of twenty symbol positions. Each symbol position in the basic game corresponds to a bonus-game position illustrated in second image 592 for the secondary game. Thus, it is contemplated that certain aspects of the secondary game can also include a total of twenty bonus-game positions, or at least as many bonus game positions in the secondary game as there are symbol positions in the basic game. More or fewer symbol or bonus game positions (e.g., 9, 15, 24) are contemplated by the present disclosure, including more or fewer rows (e.g., 3, 5) and/or columns (e.g., 3, 4, 6) of symbols in the basic game and bonus-game selections in the secondary game. Different configurations (e.g., line, circle, trapezoid, triangle, three-dimensional) of symbol and bonus-game positions are also contemplated by the present disclosure for the basic and secondary games. However, it is contemplated that having a one-to-one correspondence between the symbol positions of the basic game and the bonus-game positions of the secondary game can be desirable.

In the exemplary wagering game aspect illustrated in FIG. 5, after the wager is received, a basic game is played that has an associated secondary game. It is contemplated that play of the basic game can be a spin of the reels on a slot machine or play of an alternate wagering game that includes a plurality of different symbol positions. The secondary game includes a plurality of bonus game selections (e.g., 100 Percent, Here Piggy, Rock Ready, Bacon Bacon) arranged in an array of bonus-game positions. While each bonus game selection may be associated with a different bonus game, it is also contemplated that in certain aspects some of the bonus game selections may be associated with the same or the same type of bonus game. Play of the basic game determines which bonus games are played in the secondary game. For example, in a simulated movable reel game, such as that illustrated in first image 560, a spin of the reels 562*a*-562*e* results in a pig symbol appearing at symbol position 590. The pig symbol is a secondary game trigger or a bonus-event symbol that is associated with corresponding bonus-game position 594 in the secondary game. The Bacon Bacon bonus game is associated with bonus-game position 594.

After a predetermined number of secondary game trigger symbols are displayed during play of the basic game, the secondary game then proceeds to implement each of the bonus games (e.g., Bacon Bacon bonus game at bonus-game position 594) identified by the secondary game trigger symbols (e.g., the pig symbol at symbol position 590) during play of the basic game. By way of example, if the predetermined number of secondary game trigger or bonus-event symbols is one, the wagering game illustrated in FIG. 5 would proceed with implementing the bonus game associated with bonus-game position 594 following the display of the pig symbol at symbol position 590. However, if the predetermined number of secondary game trigger symbols is greater than one, then further play of the basic game proceeds including additional reel spin(s) until additional secondary game trigger symbol(s) (e.g., pig symbol) are displayed in symbol position(s) other than symbol position 590, such that additional bonus-game positions and associate bonus games are identified for play in the secondary game.

Figure 6:
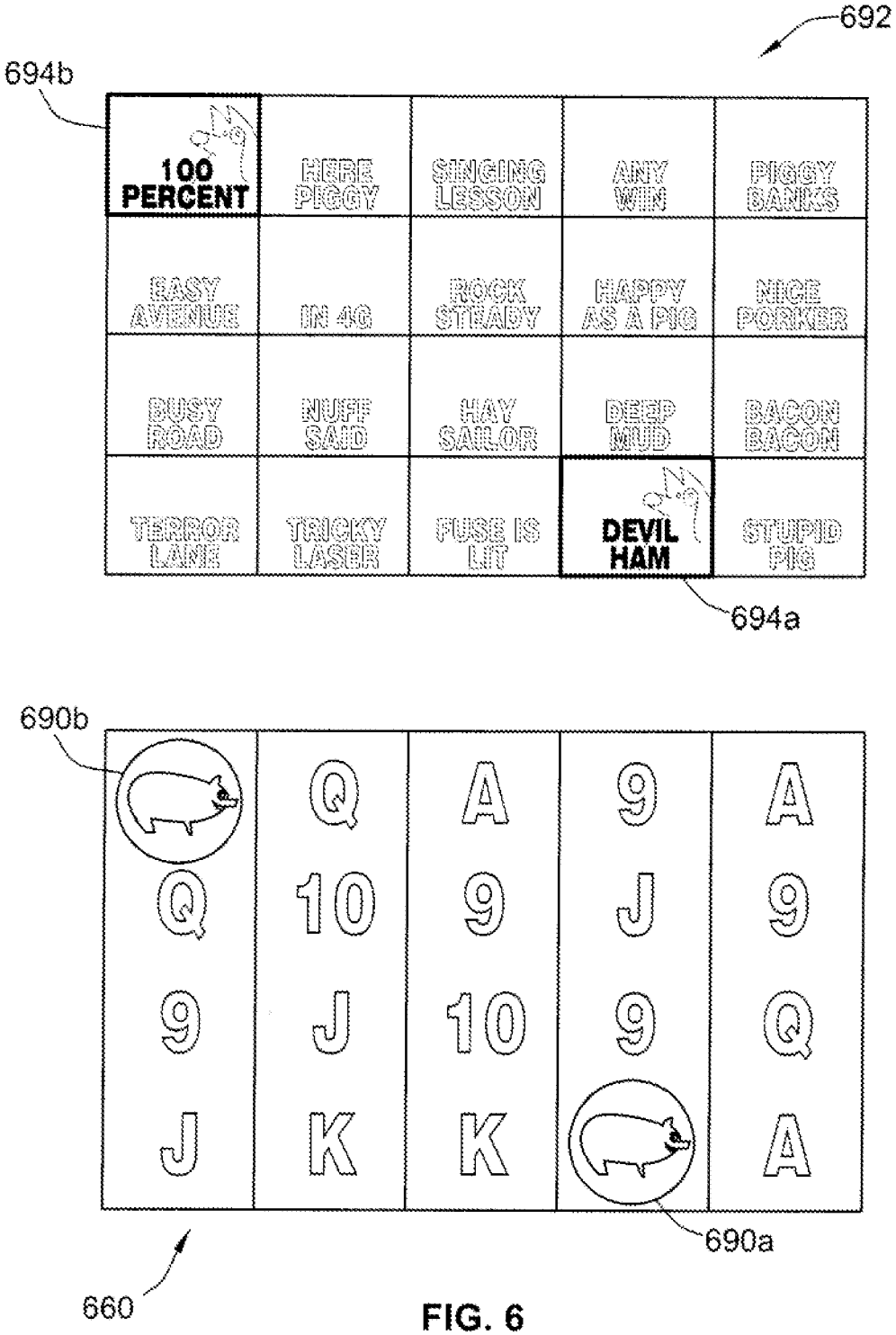
FIG. 6 is an image of plurality of simulated movable reels for another basic game and a plurality of bonus game selections for a secondary game displayed on a wagering game terminal, according to an exemplary aspect of the present disclosure.

Referring now to FIG. 6, a bottom image 660 including a plurality of simulated movable reels is illustrated for a basic game, and a top image 692 including a plurality of bonus game selections (e.g., Devil Ham, 100 Percent, Easy Avenue, Bacon Bacon, Nice Porker) is illustrated for a secondary game. Similar to FIG. 5, the basic game associated with image 660 has symbols (e.g., 9, 10, J, Q, K, A, pig) arranged in an array of symbol positions (e.g., 690*a*, 690*b*). The secondary game associated with image 692 also has bonus game selections arranged in an array of bonus-game positions (e.g., 694*a*, 694*b*).

Like the exemplary wagering game aspects described for FIG. 5, more or fewer symbol or bonus game positions are contemplated for the basic game and secondary game illustrated in FIG. 6, including more or fewer rows and/or columns of symbols and bonus-game selections, and different configurations of symbols and bonus-game selections.

Bottom image 660 illustrates an exemplary outcome of a spin of simulated movable reels. The outcome includes a pig symbol in first symbol position 690*a* and another pig symbol in second symbol position 690*b*. The pig symbols are secondary-game-trigger or bonus-event symbols that are respectively associated with corresponding bonus-game positions 694*a*, 694*b* in the secondary game illustrated in top image 692. After a predetermined number of secondary-game-trigger symbols are displayed during play of the basic game, the secondary game includes implementing the bonus games (e.g., Devil Ham, 100 Percent) identified in the corresponding bonus-game positions (e.g., 694*a*, 694*b*). By way of further example, if the predetermined number of secondary-game-trigger or bonus-event symbols is two, the wagering game illustrated in FIG. 6 immediately proceeds with implementing the bonus games associated with bonus-game positions 694*a*, 694*b*. However, if the predetermined number of secondary game trigger symbols is greater than two, then further play of the basic game proceed until additional secondary-game-triggering symbol(s) (e.g., pig symbols) are displayed in a symbol position other than symbol positions 694*a*, 694*b* such that additional bonus-game positions and associated bonus games are identified for play in the secondary game.

Figure 7:
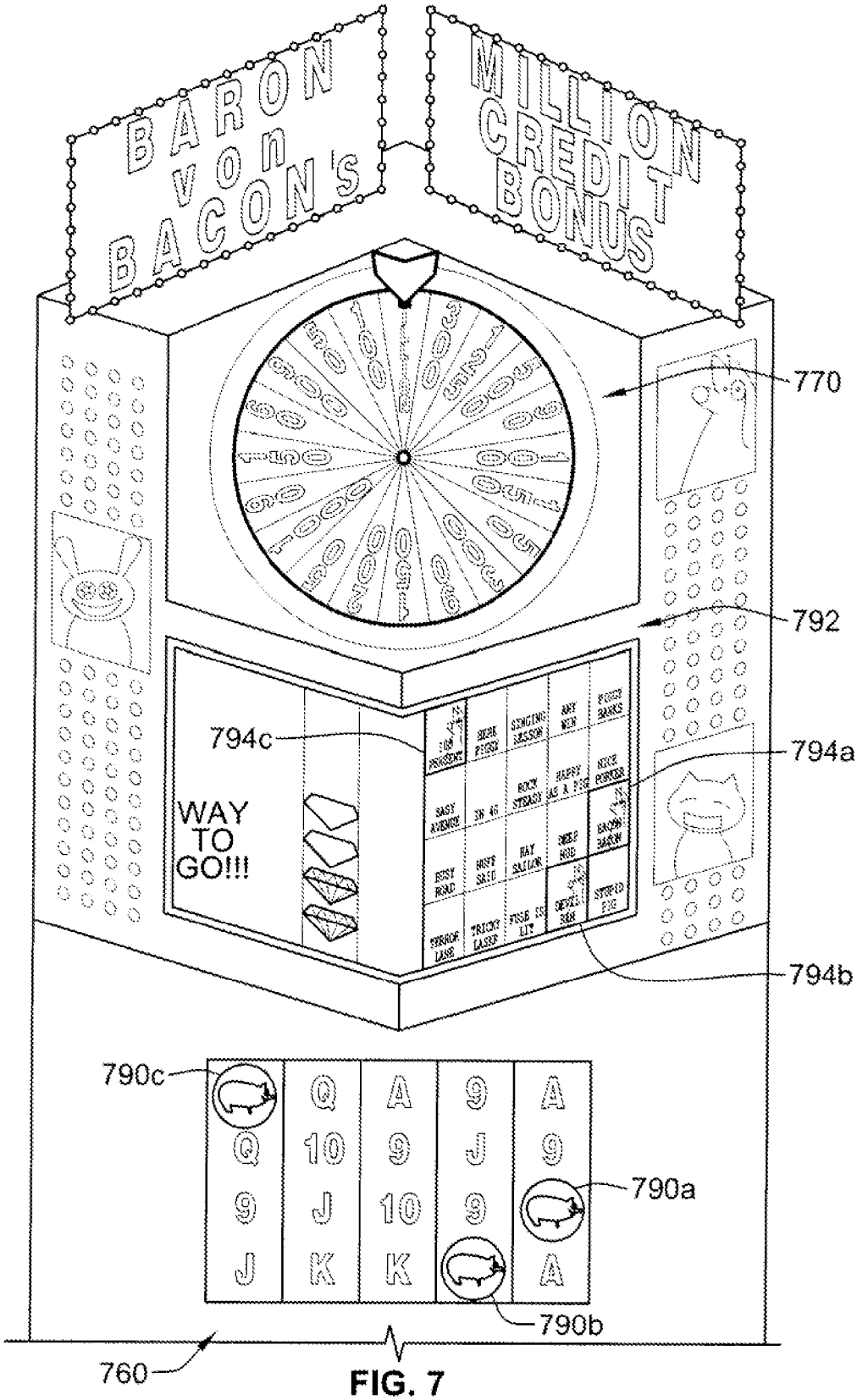
FIG. 7 is an image of a display area including a plurality of simulated movable reels for a basic game and a plurality of bonus game selections for a secondary game associated with a wagering game displayed on a gaming terminal, according to an exemplary aspect of the present disclosure.

Turning now to FIG. 7, additional wagering game aspects are illustrated. A base game display area 760 and secondary game display area 792 are illustrated with respect to additional wagering game aspects such as a million credit bonus game that includes a spinning wheel 770. Similar to the basic game illustrated by images 560, 660 in FIGS. 5 and 6, base game display area 760 includes symbols arranged in an array of symbol positions. Likewise, secondary game display area 792 includes bonus game selections arranged in an array of bonus-game positions, similar to the secondary games illustrated in images 592, 692. An exemplary spin of simulated movable reels in basic game display area 760 has an outcome that includes pig symbols in first symbol position 790*a*, second symbol position 790*b*, and third symbol position 790*c*. The pig symbols are secondary-game-trigger or bonus-event symbols that are respectively associated with corresponding bonus-game positions 794*a*, 794*b*, 794*c* in the secondary game display area 792. After a predetermined number of secondary-game-trigger symbols are displayed during play of the basic game, the secondary game then implements the bonus games (e.g., Bacon Bacon, Devil Ham, 100 Percent) identified in the corresponding bonus-game positions (e.g., 794*a*, 794*b*, 794*c*). By way of example, if the predetermined number of secondary game trigger or bonus-event symbols is three, the secondary game illustrated in FIG. 7 proceeds with implementing the bonus game associated with bonus-game positions 794*a*, 794*b*, 794*c*.

It is contemplated that in certain aspects of the present disclosure, the wagering game illustrated in FIG. 7 can also represent a summary of multiple plays of a basic game and the associated identification of bonus-game positions for the secondary game. By way of example, a single pig symbol (e.g., 790*a*) may have been displayed in one play of a basic game. Two pig symbols (e.g., 790*b*, 790*c*) may have also been displayed in subsequent play of the basic game. If the exemplary predetermined number of bonus-game positions to be identified for the secondary game is three, then the secondary game may proceed to display the pig symbols in the first, second, and third symbol positions 790*a*, 790*b*, 790*c* in the basic game display area 760 and the bonus-game positions 794*a*, 794*b*, 794*c* in the secondary game display area 792 before implementing the bonus games (e.g., Bacon Bacon, Devil Ham, 100 Percent) associated with the identified bonus-game positions.

It is contemplated that certain events during or after play of the basic and/or secondary game may allow a player the opportunity to win an award associated with a spin of wheel 770 or an award associated with another type of game. For example, when a player places a maximum wager in the basic game, the player may qualify to spin the million credit bonus wheel 770, or to play another type of game. By way of another example, spinning the bonus wheel 770 may be one of the bonus games associated with a bonus-game position of the secondary game. Other examples are described in FIG. 8, which includes additional exemplary aspects of the bonus game associated with the secondary game.

Figure 8:
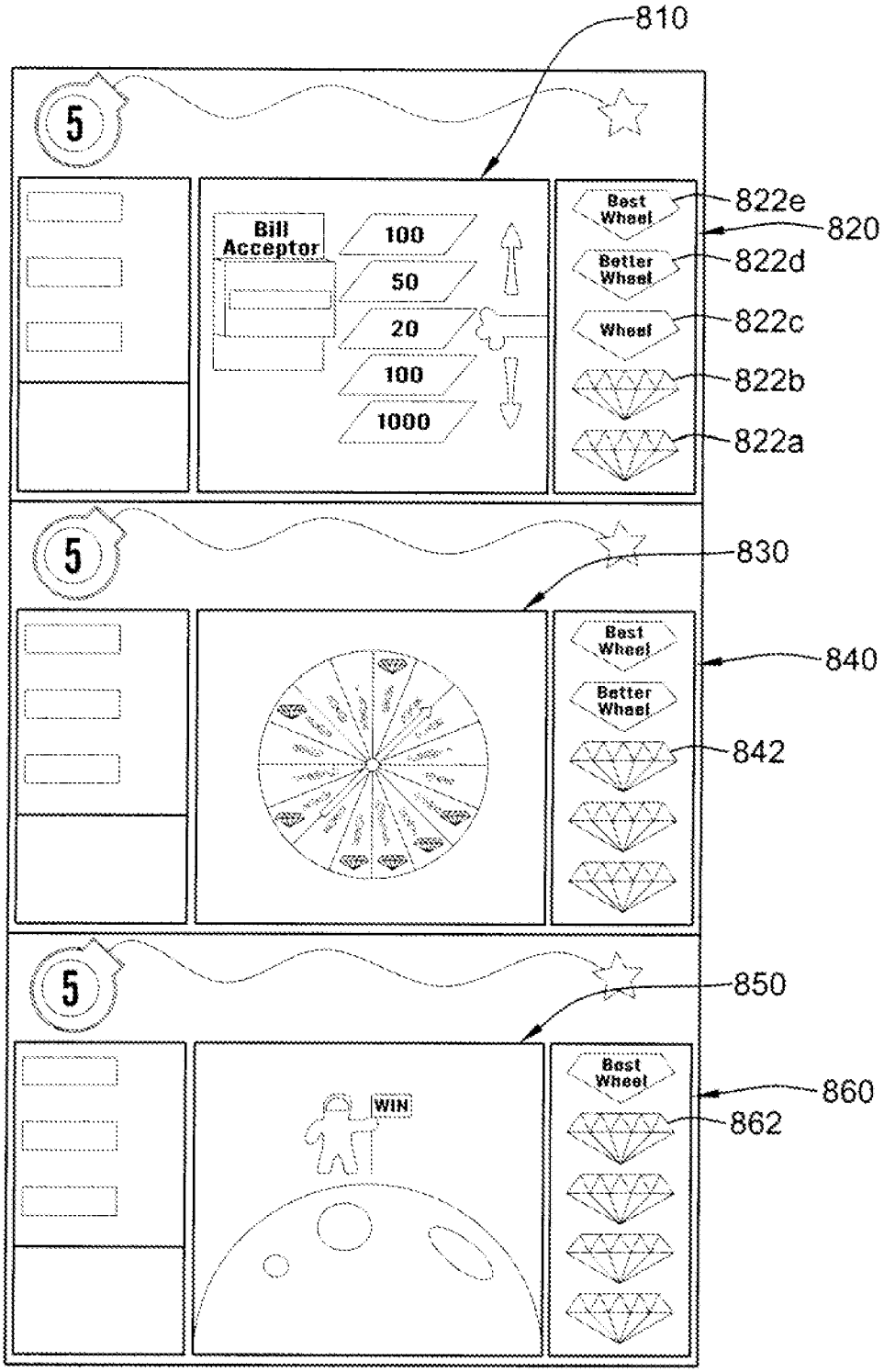
FIG. 8 is an image of a display area including a plurality of bonus games for a secondary game displayed on a wagering game terminal, according to an exemplary aspect of the present disclosure.

As described by way of the exemplary aspects illustrated in FIGS. 5-7, the secondary game proceeds to implement each of the different bonus games linked to the identified bonus game positions after a predetermined number of bonus-game positions have been identified during play of the basic game. Referring now to FIG. 8, a plurality of different bonus games 810, 830, 850 are illustrated that may be associated with the different bonus game positions of the secondary game, such as, bonus-game positions 594, 694*a*, 694*b*, 794*a*, 794*b*, 794*c* in FIGS. 5-7. The bonus games identified for the secondary game may be displayed on a different display from the basic game or on the same display in a different display area. It is contemplated that the bonus games may be implemented in the same order, or in a reverse-order, from how the bonus-game positions were originally identified during play of the basic game. It is also contemplated that the bonus games may be implemented in a random order, or the order of bonus game play may be selected by the player. After the each of the bonus game identified by the bonus-game positions have been played, it is contemplated that play of the basic game is allowed to resume. It is further contemplated that in certain aspects resumption of the basic game also restarts the secondary game.

The different bonus games identified in the array of bonus-game positions can include bonus games of varying lengths. For example, because certain secondary game aspects described in the present disclosure include implementing a plurality of bonus games, it may be desirable that the bonus-game positions be linked to short bonus games (e.g., each can be played in a few seconds) that have an easily understood and achievable goal.

It is also contemplated that bonus games implemented during the secondary game can include an auto-play feature. For example, if a player delays play of the secondary game bonus games for a predetermined period of time (e.g., five seconds, 15 seconds, 30 seconds), the processor is configured to play the bonus game through to completion, without any player input. If the secondary game has a plurality of bonus games that remain to be completed, the auto-play feature may play all the remaining bonus game, or it may begin each individual bonus game but wait a predetermined period of time before playing the game through to completion. These feature may be particularly desirable where a player does not understand the bonus game, or the player understands play of one bonus game but not another. In certain aspects, the auto-play feature may play the bonus game following player delay, but may also allow the player to override the auto-play feature after the processor has begun auto-play.

The bonus games (e.g., 810, 830, 850) can include games having different types of game mechanics. For example, a bonus game may be a picking-type game, such as first bonus game 810, where a player controls a character that can reach out to select a bill to place into a bill acceptor. The prize associated with the selected bill may be credited when the bill is placed into the bill acceptor. The prizes associated with each of the selectable bills may be hidden while the player moves a simulated hand and presses a button allowing the hand to select a desired bill. In other aspects, the prize associated with a bill may be displayed and the player simply presses a button that randomly selects one of the bills.

In another example, a bonus game may be a wheel spin game, such as second bonus game 830, where in response to a player input, a dial spins about the center of a wheel. Alternatively, a wheel can also spin about a fixed pointer (e.g., bonus wheel 770). The wheel can include several prizes, one of which is awarded to the player based on where the pointer stops or where the spinning wheel stops relative a pointer.

In another example, a bonus game may be a different type of picking game, such as third bonus game 850, where a player can select from different locations to plant a flag on a virtual surface. Each of the different locations can have a different prize associated therewith that are hidden from the player, and that are subsequently uncovered or revealed upon the player's planting the flag at the selected location.

It is further contemplated that other desirable bonus games for the secondary game can also include a spinning-reel type game (e.g., a slots game) or player-directed adventure type games. It is contemplated that some or all of the bonus games may seek player input, and that some or all of the bonus games may be implemented automatically by the gaming machine following the identification of a predetermined number of bonus-game positions during play of a basic game.

In addition to playing each of the different bonus games identified during play of the basic game, an additional bonus game may be implemented as part of the secondary game. The additional bonus game may be associated with each of the different bonus games. For example, each of the different bonus games (e.g., 810, 830, 850) may have a specific achievable goal that once successfully attained, provides the bonus game award to the player along with a separate or additional award. The additional bonus game is played for each of the different bonus game so that the value of the separate award can increase for each bonus game that the player successfully attains the goal.

To illustrate play of the additional bonus game, an exemplary aspect is described with respect to FIG. 8. Display areas 820, 840, 860 include a total of five gems (e.g., 822*a*-822*e*), of which a player may be initially awarded, for example, two gems 822*a*-822*b* for entering a bonus-game-completion phase of the secondary game (e.g., in response to a predetermined number of bonus-game positions having been identified). Play of bonus game 810 may have a certain achievable goal (e.g., selecting a bill of $100 or greater), which results in the player being awarded a third gem 842 that is displayed in display area 840 during play of the next bonus game 830. Similarly, play of bonus game 830 may also have a certain achievable goal (e.g., the pointer pointing to a prize that includes a gem), which results in the player being awarded a fourth gem 862 that is displayed in display area 850 during play of third bonus game 850. Play of bonus game 850 may have its own achievable goal, such as planting the flag at a location that has a gem, which then allows the player to achieve all five gems.

The additional bonus game can include a variety of different bonuses, such as, for example, a spin of wheel 770 in FIG. 7. In certain aspects, achieving all five gems may provide a player an improved set of prizes on the wheel. Whereas, achieving only three gems provides the player an opportunity to spin the wheel and win an additional bonus prize, but at reduced award levels than if the player had achieved four or five gems. The additional bonus game associated with the bonus games 810, 830, 850 can be desirable because it provides a player additional excitement. In certain aspects, in addition to the prizes awarded for each the bonus game, the separate bonus game can provide the player better award opportunities.

It is contemplated that in certain aspects of the secondary game it may be desirable for the basic game symbol positions to correspond to different progressive jackpot positions on a secondary game display area. For example, the basic game may have symbols including progressive-award-triggering symbols that can be arranged in an array of symbol positions for the basic game. Each of the symbol positions may have a corresponding position in a separate array of progressive-award positions for the secondary game. Each progressive-award position can be linked to a different progressive jackpot. Prizes associated with the progressive jackpots may be awarded when at least a predetermined number of progressive-award-triggering symbols are displayed in the array of symbol positions for the basic game. In certain aspects of the wagering game, the array of symbol positions for the basic game may correspond to a combination of bonus game and progressive jackpot positions in the separate array for the secondary game, and thus, allow a player the opportunity to win progressive jackpots and to play bonus games as part of the player's secondary game experience. It is contemplated that the progressive jackpots described herein can be funded via methods known in the art, such as through certain percentages of received wagers.

Figure 9:
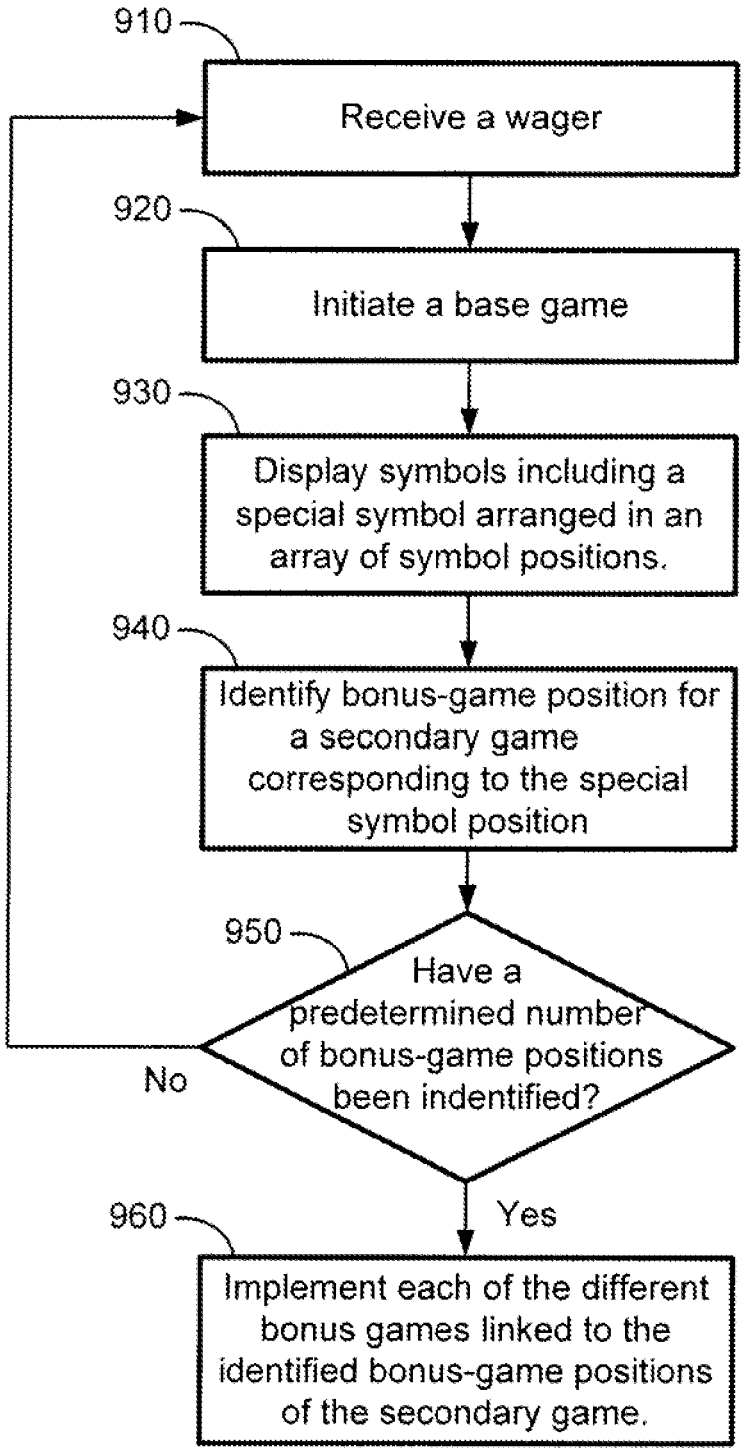
FIG. 9 is a flowchart of an exemplary algorithm that corresponds to instructions executed by a controller in accordance with at least some exemplary aspects of the present disclosure.

FIG. 9 is a flowchart of an exemplary algorithm that corresponds to instructions executed by a controller in accordance with at least some aspects of the present disclosure. FIG. 9 includes an exemplary method for conducting a wagering game including a basic game or base game in which a player input is received and wagering game outcome(s) are determined, along with the possibility of one or more special (e.g., bonus event, second game trigger) symbols being displayed. The special symbols are associated with a secondary game that includes bonus games that are implemented after a predetermined number of special symbols have been displayed during play of the basic game. It is contemplated that the secondary game may be implemented based on a predetermined number of special symbols being display during one play of the basic game and/or during a series of plays of the basic game.

Beginning with step 910, a wager is received. The receiving of a wager can include receiving a player input via a user interface device, transforming the player input to electronic data signals at least partially indicative of a wager to play the wagering game, and interpreting, via one or more processors, the wager from the data signals. Receiving of the wager can also include initiating the recording of a digital representation of the wager in one or more storage devices. Following receipt of a wager, at step 920, a basic game of the wagering game is initiated via at least one of the processors. The basic game may be of any of the varieties discussed in the present disclosure—by way of example, see the embodiments described for FIG. 3, 5, 6, or 7. At step 930, the basic game can include displaying symbols that are arranged in an array of symbol positions. The displayed symbols in the array of symbol positions can include one or more special symbols (e.g., bonus-event symbols, secondary-game-trigger symbols) or the displayed symbols can include no special symbols. It is contemplated that symbols may be displayed via any of the displays or display methods described elsewhere in the present disclosure.

Next, at step 940, if a special symbol is displayed in the basic game, a corresponding bonus-game position associated with a secondary game is identified. The bonus-game position in a second display area for the secondary game corresponds to the symbol position of the special symbol in a first display area for the basic game. It is contemplated that more than one special symbol may appear in a symbol position during play of a basic game.

Next, at step 950, a determination is made whether a predetermined number (e.g., 2, 5, 7, 10, 13, 20) of bonus-game positions in a second display area have been identified as part of the secondary game. If the predetermined number has not been met and/or exceeded, then the wagering game returns to step 910 and the basic game can continue with another wager, initiation of another basic game, a fresh display of symbols, and the possible identification of bonus-game position(s) based on the outcome of the fresh display of symbols in step 930. If the predetermined number of identified bonus-game positions has been met and/or exceeded based on the display of special symbols in step 930, the secondary game is completed at step 960 by implementing each of the different bonus games linked to the respective identified bonus-game positions. The different bonus games can be implemented in succession according to the order that the respective bonus-game positions where identified by the display of the special symbol(s). It is also contemplated that the different bonus games can be implemented according to a reverse order of identification. It is further contemplated that the order the different bonus games are played is randomly determined or determined according to a player selection.

FIG. 9, which is described by way of example above, represents an exemplary algorithm that corresponds to at least some instructions executed by the controller 42 and/or external systems 46 in FIG. 2 to perform the above described functions associated with the disclosed aspects of the present disclosure.

It is contemplated that in certain aspects of the present disclosure, a gaming system can include an input device configured to receive a wager to play a wagering game having a basic game and a secondary game. The secondary game includes a plurality of bonus games. One or more display devices are configured to display a plurality of symbols arranged in an array of symbol positions in a first display area for the basic game. Each symbol position has a corresponding position in an array of bonus-game positions in a second display area for the secondary game. Each bonus-game position is linked to a different bonus game. One or more processors are operative to vary the symbols displayed in the array of symbol positions during play of the basic game. The symbols include one or more secondary game trigger symbols. In response to a secondary game trigger symbol being displayed in a symbol position, the corresponding position in the array of bonus-game positions for the secondary game is identified. In response to a predetermined number of bonus-game positions being identified, the secondary game is completed by implementing each of the different bonus games linked to the identified bonus-game positions.

It is further contemplated that in certain aspects, the above gaming system can also include each of the different bonus games of the secondary game being implemented sequentially in an order determined by the display of the secondary game trigger symbol. Each of the different bonus games of the secondary game can also be implemented sequentially in the reverse of an order determined by the display of the secondary game trigger symbol. In certain aspects the predetermined number of bonus game positions identified is two. In certain aspects, the different bonus games of the secondary game can include games having different game-play mechanics. The different game-play mechanics can include at least two or more of a picking game, a wheel-spin game, a reel-spin game, or a player-directed game sequence. After the lapse of a predetermined period of time, it is contemplated that in certain aspects an implemented bonus game of the secondary game may enter an automatic play mode. Each of the plurality of bonus games in the secondary game can also have a predetermined outcome having a predetermined award such that achieving at least one of the predetermined outcomes results in an opportunity to win an additional award beyond the predetermined award of each bonus game.

It is contemplated that in certain aspects of the present disclosure, a method of conducting a wagering game on a gaming system can include the acts of: (a) receiving an input via a user interface device, the input indicative of a wager to play the wagering game; (b) after receiving the input, initiating a base game of the wagering game via one or more processors; (c) displaying, via one or more display devices, a plurality of symbols arranged in an array of symbol positions in a first display area for the base game, the symbols including one or more special symbols, each symbol position having a corresponding bonus-game position in an array of bonus-game positions in a second display area, each bonus-game position linked to a different bonus game; (d) in response to a special symbol being displayed in a symbol position during play of the base game, identifying the corresponding bonus-game position in the array of bonus-game positions; (e) repeating acts (a) through (d) until a plurality of bonus-game positions are identified; and (f) in response to a plurality of bonus-game positions being identified, implementing each of the different bonus games linked to the identified bonus-game positions.

It is further contemplated that in certain aspects, the above method can also include each of the different bonus games being implemented in a random order. Each of the different bonus games can also be sequentially implemented according to an order determined by the display of the special symbol. The different bonus games may include one or more of a picking game, a wheel-spin game, and a reel-spin game. In certain aspects, after the lapse of a predetermined period of time, an implemented bonus game can enter an automatic play mode. Each bonus game may have a predetermined outcome that results in a predetermined bonus award such that achieving all of the predetermined outcomes results in one or more additional bonus awards in addition to the predetermined bonus award for each bonus game.

It is contemplated that in certain aspects of the present disclosure, a gaming machine is configured to play a wagering game having a basic game and a secondary game including a plurality of bonus games. The gaming machine includes an input device configured to receive a wager to play the basic game. One or more display devices are configured to display a plurality of symbols arranged in an array of symbol positions in a primary display area associated with the basic game. Each symbol position has a corresponding bonus-event position in an array of bonus-event positions in a secondary display area associated with the secondary game. Each bonus-event position of the secondary game is linked to a different bonus game. One or more processors are operative to vary the symbols displayed in the array of symbol positions during play of the basic game. The symbols include one or more bonus-event symbols. In response to a bonus-event symbol being displayed in a symbol position during play of the basic game, the corresponding bonus-event position is identified in the array of bonus-event positions for the secondary game. In response to a predetermined number of bonus-event positions being identified for the secondary game, the secondary game is completed by implementing each of the different bonus games linked to the identified bonus-event positions. Immediately after completing the secondary game, play of the basic game is resumed.

It is further contemplated that in certain aspects, the above gaming machine can also include each of the different bonus games of the secondary game being implemented sequentially according to an order determined by the display of the bonus-event symbol. The different bonus games may include one or more of a picking game, a wheel-spin game, and/or a reel-spin game. In certain aspects, after the lapse of a predetermined period of time, an implemented bonus game can enter an automatic play mode. Each bonus game may have a predetermined outcome that results in a predetermined bonus award such that achieving all of the predetermined outcomes results in an additional award for the secondary game.

It is contemplated that in certain aspects of the present disclosure, a computer program product comprising a non-transitory computer readable medium has an instruction set borne thereby. The instruction set is configured to cause, upon execution by a controller, the acts of: (a) receiving a wager via a user interface device, the wager associated with a wagering game; (b) initiating, via one or more processors, a basic game of the wagering game; (c) displaying, via one or more display devices, a plurality of symbols arranged in an array of symbol positions in a first display area for the basic game, the symbols including one or more bonus-event symbols, each symbol position having a corresponding position in an array of bonus-game positions for a secondary game displayed in a second display area, each bonus-game position linked to a different bonus game of the secondary game; (d) in response to a bonus-event symbol being displayed in a symbol position during play of the basic game, identifying the corresponding position in the array of bonus-game positions; (e) repeating acts (a) and (d) until at least two bonus-game positions are identified as part of the secondary game; and (f) in response to at least two bonus-game positions being identified, implementing each of the different bonus games linked to the identified bonus-game positions.

It is contemplated that in certain aspects of the present disclosure, a computer-implemented method can include (a) receiving a wager via at least one input device; (b) in response to receiving the wager, initiating a basic game via one or more processors; (c) displaying, on at least one display device, a plurality of symbols arranged in an array of basic-game symbol positions, the symbols including one or more special symbols, each basic-game symbol position having a corresponding bonus-game position in an array of bonus-game positions in a second display area, each bonus-game position linked to a different bonus game; (d) in response to a special symbol being displayed in a basic-game symbol position during the basic game, identifying the corresponding bonus-game position in the array of bonus-game positions; (e) repeating acts (a) through (d) until a plurality of bonus-game positions are identified; and (f) in response to a plurality of bonus-game positions being identified, implementing each of the different bonus games linked to the identified bonus-game positions.

It is further contemplated that in certain aspects, the above gaming machine can also include each of the different bonus games being implemented sequentially according to the order identified by the display of the special symbol. In certain aspects, after the lapse of a predetermined period of time, an implemented bonus game can enter an automatic play mode. Each bonus game can have a predetermined outcome resulting in a predetermined bonus award such that achieving all of the predetermined outcomes results in one or more additional bonus awards in addition to the predetermined bonus award for each bonus game.

It is contemplated that in certain aspects of the present disclosure, a gaming system can include at least one input device, at least one display device, at least one processor; and at least one memory device which stores a plurality of instructions which, when executed by the at least one processor, cause the at least one processor to operate with the at least one display device and the least one input device to implement several acts. The acts include: (a) receiving a wager, (b) in response to receiving the wager, initiating a basic game and a secondary game, the secondary game including a plurality of bonus games, (c) displaying, on the at least one display device, a plurality of symbols arranged in an array of symbol positions in a first display area for the basic game, each symbol position having a corresponding position in an array of bonus-game positions in a second display area for the secondary game, each bonus-game position linked to a different bonus game, (d) vary the symbols displayed in the array of symbol positions during play of the basic game, the symbols including one or more secondary game trigger symbols, (e) in response to a secondary game trigger symbol being displayed in a symbol position, identifying the corresponding position in the array of bonus-game positions for the secondary game, and (f) in response to a plurality of bonus-game positions being identified, completing the secondary game by implementing each of the different bonus games linked to the identified bonus-game positions.

It is further contemplated that in certain aspects, the above gaming machine can also include the different bonus games of the secondary game being games having different gameplay mechanics.

According to a further aspect of the present disclosure, one or more non-transitory computer readable storage media are encoded with instructions, which when executed by at least one processor or controller associated with a gaming system, causes the at least one processor or controller to perform the above methods.

Each of these embodiments and obvious variations thereof is contemplated as falling within the spirit and scope of the claimed invention, which is set forth in the following claims.

What is claimed is:

1. A gaming system comprising:

an input device configured to receive a wager to play a wagering game having a basic game and a secondary game, the secondary game including a plurality of bonus games;

one or more display devices configured to display a plurality of symbols arranged in an array of symbol positions in a first display area for the basic game, each symbol position having a corresponding position in an array of bonus-game positions in a second display area for the secondary game, each bonus-game position linked to a different bonus game; and at least one memory device which stores a plurality of instructions which, when executed by one or more processors, cause at least one of the one or more processors to operate with least one of the one or more display devices to (i) varying the symbols displayed in the array of symbol positions during play of the basic game, the symbols including one or more secondary game trigger symbols, (ii) in response to a secondary game trigger symbol being displayed in a symbol position, identify the corresponding position in the array of bonus-game positions for the secondary game, and (iii) in response to a plurality of bonus-game positions being identified, complete the secondary game by implementing each of the different bonus games linked to the identified bonus-game positions.

2. The gaming system of claim 1, wherein each of the different bonus games of the secondary game are implemented sequentially according to an order determined by the display of the secondary game trigger symbol.

3. The gaming system of claim 1, wherein each of the different bonus games of the secondary game are implemented sequentially in reverse of an order determined by the display of the secondary game trigger symbol.

4. The gaming system of claim 1, wherein the plurality of bonus-game positions is two bonus-game positions.

5. The gaming system of claim 1, wherein the different bonus games of the secondary game include games having different game-play mechanics.

6. The gaming system of claim 5, wherein the different game-play mechanics include at least two or more of a picking game, a wheel-spin game, a reel-spin game, or a player-directed game sequence.

7. The gaming system of claim 1, wherein after the lapse of a predetermined period of time, an implemented bonus game of the secondary game enters an automatic play mode.

8. The gaming system of claim 1, wherein each the plurality of bonus games in the secondary game has a predetermined outcome having a predetermined award, and wherein achieving at least one of the predetermined outcomes results in an opportunity to win an additional award beyond the predetermined award of each bonus game.

9. A method of conducting a wagering game on a gaming system, the method comprising the acts of:

(a) receiving an input via a user interface device, the input indicative of a wager to play the wagering game;

(b) after receiving the input, initiating a base game of the wagering game via one or more processors;

(c) displaying, via one or more display devices, a plurality of symbols arranged in an array of symbol positions in a first display area for the base game, the symbols including one or more special symbols, each symbol position having a corresponding bonus-game position in an array of bonus-game positions in a second display area, each bonus-game position linked to a different bonus game;

(d) in response to a special symbol being displayed in a symbol position during play of the base game, identifying the corresponding bonus-game position in the array of bonus-game positions;

(e) repeating acts (a) through (d) until a plurality of bonus-game positions are identified; and (f) in response to a plurality of bonus-game positions being identified, implementing each of the different bonus games linked to the identified bonus-game positions.

10. The method of claim 9, wherein each of the different bonus games are implemented in a random order.

11. The method of claim 9, wherein each of the different bonus games are sequentially implemented according to an order determined by the display of the special symbol.

12. The method of claim 9, wherein the different bonus games include one or more of a picking game, a wheel-spin game, and a reel-spin game.

13. The method of claim 9, wherein after the lapse of a predetermined period of time, an implemented bonus game enters an automatic play mode.

14. The method of claim 9, wherein each bonus game has a predetermined outcome resulting in a predetermined bonus award such that achieving all of the predetermined outcomes results in one or more additional bonus awards in addition to the predetermined bonus award for each bonus game.

15. A gaming machine configured to play a wagering game having a basic game and a secondary game including a plurality of bonus games, the gaming machine comprising:

an input device configured to receive a wager to play the basic game;

one or more display devices configured to display a plurality of symbols arranged in an array of symbol positions in a primary display area associated with the basic game, each symbol position having a corresponding bonus-event position in an array of bonus-event positions in a secondary display area associated with the secondary game, each bonus-event position of the secondary game linked to a different bonus game; and at least one memory device which stores a plurality of instructions which, when executed by one or more processors, cause at least one of the one or more processors to operate with least one of the one or more display devices to (i) varying the symbols displayed in the array of symbol positions during play of the basic game, the symbols including one or more bonus-event symbols, (ii) in response to a bonus-event symbol being displayed in a symbol position during play of the basic game, identifying the corresponding bonus-event position in the array of bonus-event positions for the secondary game, (iii) in response to a plurality of bonus-event positions being identified for the secondary game, completing the secondary game by implementing each of the different bonus games linked to the identified bonus-event positions, and (iv) immediately after completing the secondary game, resuming play of the basic game.

16. The gaming machine of claim 15, wherein each of the different bonus games of the secondary game are implemented sequentially according to an order determined by the display of the bonus-event symbol.

17. The gaming machine of claim 15, wherein the different bonus games include one or more of a picking game, a wheel-spin game, and a reel-spin game.

18. The gaming machine of claim 15, wherein after the lapse of a predetermined period of time, an implemented bonus game enters an automatic play mode.

19. The gaming machine of claim 15, wherein each bonus game has a predetermined outcome resulting in a predetermined bonus award such that achieving all of the predetermined outcomes results in an additional award for the secondary game.

20. A computer program product comprising a non-transitory computer readable medium having an instruction set borne thereby, the instruction set being configured to cause, upon execution by a controller, the acts of:

(a) receiving a wager via a user interface device, the wager associated with a wagering game;

(b) initiating, via one or more processors, a basic game of the wagering game;

(c) displaying, via one or more display devices, a plurality of symbols arranged in an array of symbol positions in a first display area for the basic game, the symbols including one or more bonus-event symbols, each symbol position having a corresponding position in an array of bonus-game positions for a secondary game displayed in a second display area, each bonus-game position linked to a different bonus game of the secondary game;

(d) in response to a bonus-event symbol being displayed in a symbol position during play of the basic game, identifying the corresponding position in the array of bonus-game positions;

(e) repeating acts (a) and (d) until at least two bonus-game positions are identified as part of the secondary game; and (f) in response to at least two bonus-game positions being identified, implementing each of the different bonus games linked to the identified bonus-game positions.

21. A gaming system comprising:

at least one input device;

at least one display device;

at least one processor; and at least one memory device which stores a plurality of instructions which, when executed by the at least one processor, cause the at least one processor to operate with the at least one display device and the least one input device to:

(a) receive a wager, (b) in response to receiving the wager, initiate a basic game and a secondary game, the secondary game including a plurality of bonus games, (c) display, on the at least one display device, a plurality of symbols arranged in an array of symbol positions in a first display area for the basic game, each symbol position having a corresponding position in an array of bonus-game positions in a second display area for the secondary game, each bonus-game position linked to a different bonus game, (d) vary the symbols displayed in the array of symbol positions during play of the basic game, the symbols including one or more secondary game trigger symbols, (e) in response to a secondary game trigger symbol being displayed in a symbol position, identify the corresponding position in the array of bonus-game positions for the secondary game, and (f) in response to a plurality of bonus-game positions being identified, complete the secondary game by implementing each of the different bonus games linked to the identified bonus-game positions.

22. The gaming system of claim 21, wherein the different bonus games of the secondary game include games having different game-play mechanics.

23. The gaming system of claim 21, wherein after the lapse of a predetermined period of time, an implemented bonus game enters an automatic play mode.

24. The gaming system of claim 21, wherein each bonus game has a predetermined outcome resulting in a predetermined bonus award such that achieving all of the predetermined outcomes results in one or more additional bonus awards in addition to the predetermined bonus award for each bonus game.

* * * * *